US012672721B2

(12) United States Patent
Huttenhuis

(10) Patent No.: US 12,672,721 B2
(45) Date of Patent: Jul. 7, 2026

(54) SEAT

(71) Applicant: P.R. Sella B.V., Denekamp (NL)

(72) Inventor: Aloysius Gerhardus Huttenhuis, Denekamp (NL)

(73) Assignee: P.R. Sella B.V., Denekamp (NL)

( * ) Notice: Subject to any disclaimer, the term of this patent is extended or adjusted under 35 U.S.C. 154(b) by 182 days.

(21) Appl. No.: 18/692,518

(22) PCT Filed: Sep. 9, 2022

(86) PCT No.: PCT/NL2022/050509
§ 371 (c)(1),
(2) Date: Mar. 15, 2024

(87) PCT Pub. No.: WO2023/043307
PCT Pub. Date: Mar. 23, 2023

(65) Prior Publication Data

US 2024/0374035 A1 Nov. 14, 2024

(30) Foreign Application Priority Data

Sep. 17, 2021 (NL) ..... 2029202

(51) Int. Cl.
*A47C 7/14* (2006.01)
*A47C 7/22* (2006.01)
*A47C 7/28* (2006.01)

(52) U.S. Cl.
CPC ..... *A47C 7/14* (2013.01); *A47C 7/22* (2013.01); *A47C 7/282* (2013.01)

(58) Field of Classification Search
CPC .. A47C 7/14; A47C 7/22; A47C 7/282; A61G 5/1045; A47C 7/287
See application file for complete search history.

(56) References Cited

U.S. PATENT DOCUMENTS 3,981,538 A 9/1976 Chubb
4,522,447 A * 6/1985 Snyder ..... A47C 7/18 297/452.32
4,883,320 A 11/1989 Izumida et al.
5,282,286 A * 2/1994 MacLeish ..... A61G 5/1045 5/655.3
5,442,823 A * 8/1995 Siekman ..... A47C 7/029 5/653
6,609,753 B2 * 8/2003 Schmidt-Schaeffer ..... A47C 7/28 297/354.13
6,990,744 B2 * 1/2006 Bieganek ..... A47C 31/126 33/515

(Continued)

FOREIGN PATENT DOCUMENTS

FR 1563258 A 4/1969
GB 1119818 A 7/1968
JP 2000116469 A 4/2000

*Primary Examiner* — Magdalena Topolski
*Assistant Examiner* — Shanna Danielle Glover
(74) *Attorney, Agent, or Firm* — The Webb Law Firm

(57) ABSTRACT

The invention relates to a seat for supporting a bottom of a seated user, which seat includes a first seat part for supporting a first part of the bottom of the user and a second seat part for supporting a second part of the bottom of the user. The first seat part is elastically deformable and has a first modulus of elasticity. The second seat part has a second modulus of elasticity which is at least 10 times greater than the first modulus of elasticity.

10 Claims, 2 Drawing Sheets

(56) References Cited

U.S. PATENT DOCUMENTS

| | | | | |
|---|---|---|---|---|
| 7,220,376 | B2 * | 5/2007 | Hetzel | A61G 5/1043 264/222 |
| 2011/0006582 | A1 * | 1/2011 | Carlson | A61G 5/1054 297/452.64 |

* cited by examiner

SEAT

CROSS REFERENCE TO RELATED APPLICATIONS

This application is the U.S. national phase of International Patent Application No. PCT/NL2022/050509 filed Sep. 9, 2022, and claims priority to The Netherlands Patent Application No. 2029202 filed Sep. 17, 2021, the disclosures of which are hereby incorporated by reference in their entireties.

BACKGROUND OF THE INVENTION

Field of the Invention

The invention relates to a seat for supporting a bottom of a seated user. Seats usually form part of a sitting device such as for instance a chair, sofa, wheelchair or other chairs, such as for instance found in transport means such as cars. Seats are known in many embodiments. In a sitting device a seat is often combined with a backrest.

Field of the Invention

In many cases a seat must be used for long periods of time, for instance due to poor mobility of the user. Wheelchairs are in these cases used allow the user to have some mobility. The prolonged use often results in pain, such as for instance pain in a person's backside. Even necrosis of tissue in the backside occurs regularly as well, also referred to as decubitus.

Many solutions have been devised to reduce or prevent such complaints. For instance in the form of special seat cushions, such as for instance anti-decubitus cushions, which can be arranged on a seat. Such cushions have for their object to reduce the peak pressures on the sensitive areas. The relief of the sensitive areas achieved with the uniform pressure distribution is however insufficient in many cases. Although the peak pressure decreases, the absolute load on the sensitive areas is often still too high. The existing solutions are therefore inadequate in many cases, particularly for users who have difficulty changing position or cannot do so independently.

SUMMARY OF THE INVENTION

It is now an object of the invention to reduce or even obviate the above stated drawbacks.

This object is achieved according to the invention with a seat for supporting a bottom of a seated user, which seat comprises a first seat part for supporting a first part of the bottom of the user and a second seat part for supporting a second part of the bottom of the user, wherein the first seat part is elastically deformable and has a first modulus of elasticity and wherein the second seat part has a second modulus of elasticity which is at least 10 times greater than the first modulus of elasticity.

With the seat according to the invention a load pattern of the bottom of the user can be obtained, wherein parts of the backside which are sensitive to sitting problems are relieved, with load being shifted to parts which are less sensitive. Such critical parts are for instance the part of the backside around the coccyx, i.e. the tail bone, and the ischium, i.e. the sit bones, although the pubic area can also form a critical part.

Because the seat has a first seat part which is able to shape itself to the first part of the bottom of the user owing to the lower modulus of elasticity, less load is imparted to the first part of the bottom of the user by the first seat part. Proportionally more load is conversely imparted by the second seat part to the second part of the bottom of the user. Owing to the higher modulus of elasticity of the second seat part relative to the first seat part, a greater load is exerted on the bottom by the second seat part. The uneven load realizes a shift of the peak pressures, preferably a shift of the load on the critical parts to parts of the bottom which are less sensitive to sitting problems, such as the thighbones, i.e. the upper legs, or the rear side of the pelvis.

An additional advantage of the seat according to the invention is that, excluding the body measurements and weight of the user, the seat requires no individual modifications and can be reused in simple manner for a random seated user having more or less the same body measurements and weight.

In order to accommodate weight variation the modulus of elasticity of the first seat part can be modified by for instance opting for a material with a different modulus of elasticity.

A further additional advantage of the seat according to the invention is that the seat can be manufactured very inexpensively. Owing to the simple construction and the suitability of known materials for application in a seat according to the invention, the seat can be widely applied without the material costs forming an obstacle.

Because the peak load is substantially shifted with a seat according to the invention, the advantages of relieving the critical parts are also preserved when the load on the backside varies, such as when a wheelchair is for instance moved over a bumpy road or during transport by car. In such cases many types of so-called anti-decubitus pillow cause the brief load increase to be distributed uniformly, and therefore over the critical parts as well. According to the invention, the first part will still experience less load than the second part in such a case of a greater load on the bottom, this owing to the elastic action of the first seat part. The first part of the bottom is therefore also relieved when the load on the bottom varies, with load being shifted to the second part of the bottom.

In an embodiment of the seat according to the invention the first modulus of elasticity is smaller than or equal to 0.01 GPa.

It has been found that with a first modulus of elasticity of the first seat part which is smaller than or equal to 0.01 sufficient elastic deformation is obtained to sufficiently reduce the load on the critical parts of the first part of the bottom. The first modulus of elasticity can particularly be selected depending on the weight of the user, wherein a higher modulus of elasticity can be opted for at a higher weight.

Another embodiment of a seat according to the invention is a seat wherein the second modulus of elasticity is greater than or equal to 0.1 GPa and preferably lies in the range of 0.1-0.9 GPa.

The second modulus of elasticity is preferably greater than 0.1 GPa because it has been found that this provides sufficient support to the second part of the bottom of the user to shift the load from the first part of the bottom to the second part of the bottom of the user. In the range of 0.1-0.9 GPa a comfortable support can be realized, wherein undesired deformation of the second seat part is prevented.

In an embodiment of the seat according to the invention the first seat part lies centrally relative to the seat and the second seat part surrounds the first seat part.

Because the stiffer second seat part surrounds the first, centrally located seat part, the second seat part can be used in simple manner to provide the necessary structural support around the first seat part which is elastically deformable.

In a preferred embodiment of a seat according to the invention the first seat part comprises the projected position of at least one of the pubic area, the coccyx or one or both sit bones of the user.

By having the shape-adapting first seat part comprise the critical parts at the position of the projected position of the coccyx and/or one or both sit bones it is effectively prevented that problematic peak loads can occur on the bottom at the corresponding points.

Another embodiment according to the invention is a seat wherein the second seat part comprises the projected position of at least a part of the thighbones of the user.

Because the thighbones are less sensitive to sitting problems than the above stated critical parts, the load is preferably on the thighbones in the second part of the bottom.

Another embodiment of a seat according to the invention is a seat wherein the second seat part comprises a flexible material and is preferably manufactured from flexible material.

Because said sitting problems often occur in wheelchair users, the flexibility required for application in a foldable chair or wheelchair is preserved when the second seat part is embodied partially or wholly from flexible material.

The second seat part is preferably arranged here between two frame parts and the seat preferably comprises a tensioned position and a flexible position, wherein the second seat part is tensioned between the two frame parts in the tensioned position and is flexible in the flexible position.

The second seat part can be embodied on the basis of for instance a flexible net or flexible straps, which is folded up when the seat is collapsed in the flexible position and becomes tensioned when the seat is in the tensioned position in the position of use. Because the second seat part acts in the tensioned position more or less as a plank, a great deal of load is taken on from the first part of the bottom by the second seat part. The higher modulus of elasticity required for the second seat part is thus achieved in the tensioned position by the tensioned flexible material of the second seat part.

Another preferred embodiment of a seat according to the invention is a seat wherein the first seat part comprises at least one elastic strap and preferably comprises at least one length-adjustable elastic strap.

The first seat part can be obtained in simple manner by applying one or more elastic straps. By making one or more elastic straps length-adjustable the ratio of the support provided by the first and second seat part can be varied in simple manner.

In yet another embodiment of a seat according to the invention the first and/or the second seat part is covered with a soft foam layer.

In order to increase the sitting comfort a soft foam cushion is placed over at least a part of the supportive surface of the seat. With a thickness of at least 2 centimetres the load is spread out a little more. Underneath the soft foam layer the support is provided by at least the first and the second seat part.

These and other features of the invention are further elucidated with reference to the accompanying drawings.

BRIEF DESCRIPTION OF THE DRAWINGS

The terms Fig., Figs., Figure, and Figures are used interchangeably in the specification to refer to the corresponding figures in the drawings.

DESCRIPTION OF THE INVENTION

Figure 1:
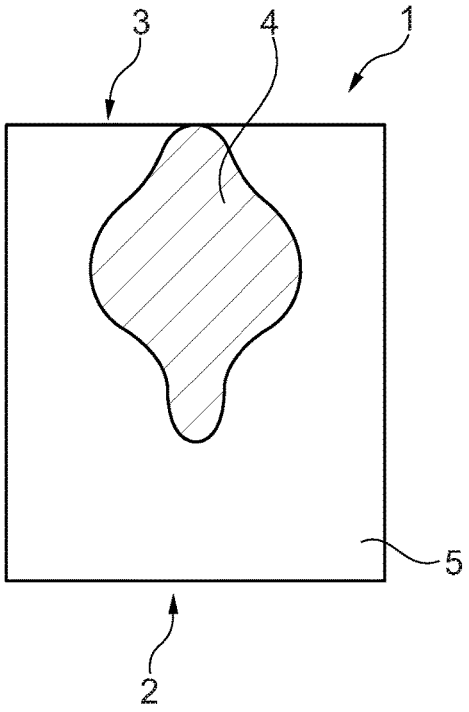
FIG. 1 shows in top view a schematic view of an embodiment of a seat according to the invention.

FIG. 1 shows a top view of a schematically shown seat 1 according to the invention. The seat 1 is used with the front side 2 at the position of the knees of the user during use. The backside of the user is then situated close to the rear side 3. Seat 1 comprises a first ventrally located seat part 4 which is surrounded by a second seat part 5. The first seat part 4 is elastically deformable and shapes itself to the adjoining supporting portions of the backside of the user during use.

Figure 2:
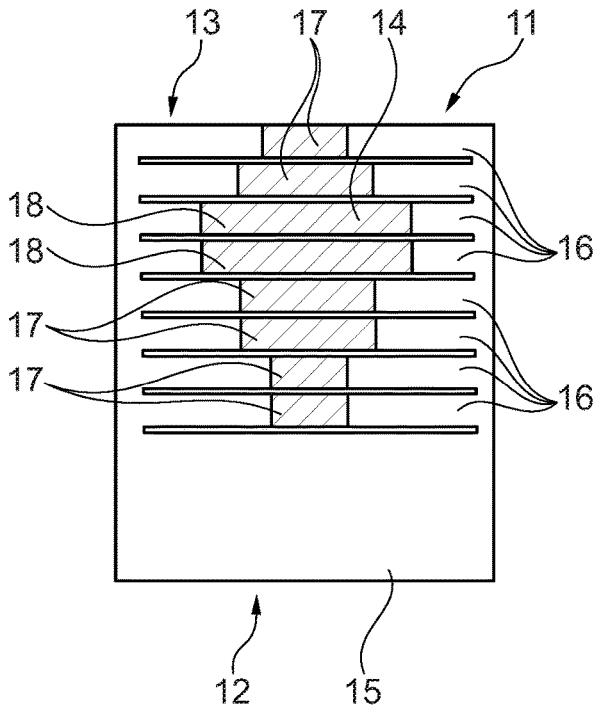
FIG. 2 shows in top view a schematic view of an embodiment of a seat according to the invention.

FIG. 2 shows a top view of a schematic view of a second embodiment of a seat 11 according to the invention with a front side 12 and rear side 13. The first 14 and second seat part 15 are constructed from flexible material. The first seat part 14 is divided into strips 16 in the width direction. The middle part of each strip 16 is formed by an elastic segment 17, 18. The length of the elastic segment 17, 18 can be varied by applying a shorter segment 17 where less deformation is necessary and a longer segment 18 where more deformation is necessary. Depending on the weight of the user it is possible to opt for an elastic strap with a higher or lower modulus of elasticity. The degree of elasticity can also be varied by varying the length of the elastic segment 17, 18. For additional comfort a soft foam cushion with a thickness of at least 2 centimetres is placed over the bearing part.

Figure 3:
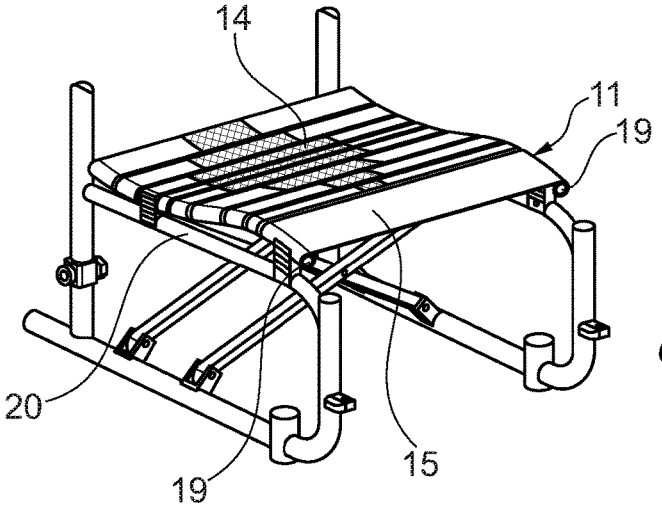
FIG. 3 shows a perspective view of the seat of FIG. 2 in an unfolded wheelchair frame.

FIG. 3 shows a perspective view of a bearing construction 19 of a seat 11 according to the embodiment shown in FIG. 2 and mounted in a wheelchair frame 20 in an unfolded and thereby tensioned state.

Figure 4:
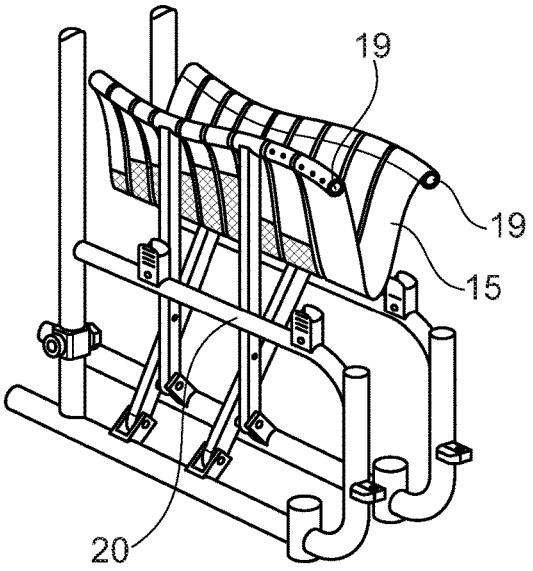
FIG. 4 shows a perspective view of the seat of FIG. 2 in a collapsed wheelchair frame.

FIG. 4 shows a perspective view of the bearing construction 19 according to FIG. 3 a collapsed state in a wheelchair frame 20. This view clearly shows that the seat 11 is flexible.

Figure 5:
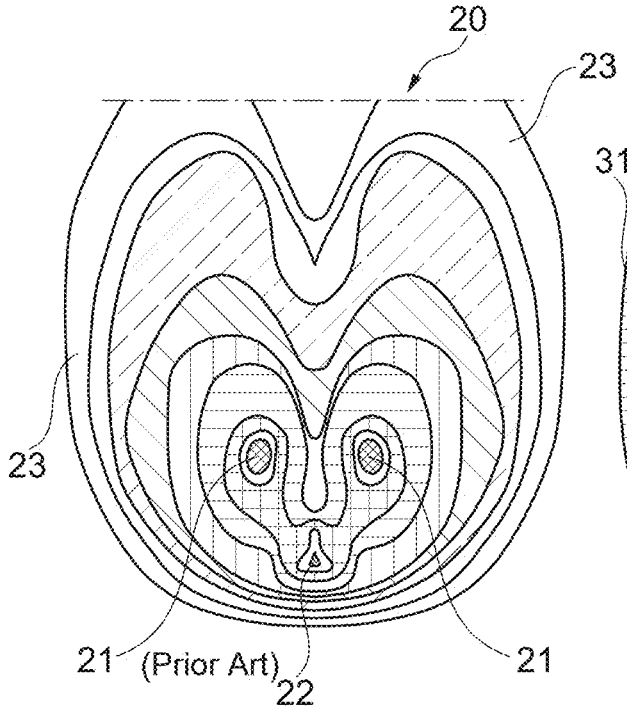
FIG. 5 shows a schematic load pattern on a traditional seat.

FIG. 5 shows a load pattern 20 of a backside seated on a tautly tensioned net, which net is provided with about 2 centimetres of soft foam. The pressure variation varies from approximately 70 millimetres of mercury under the sit bones 21 to 40 millimetres under tail bone 22, and decreases to 0 millimetres of mercury toward the edges. It is clearly visible that it is precisely the critical parts 21, 22 that experience the highest pressure load.

Figure 6:
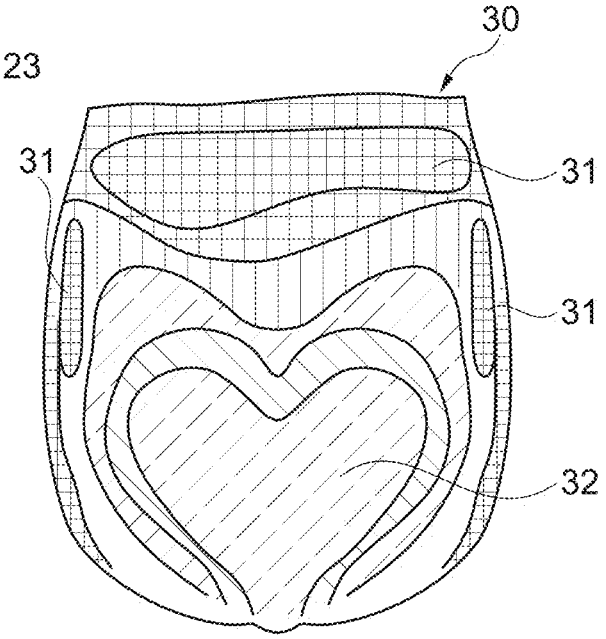
FIG. 6 shows a schematic load pattern on a seat according to the invention.

FIG. 6 shows a load pattern 30 of a seated backside on a seat according to the invention, which seat is also provided with about 2 centimetres of soft foam. The pressure variation once again varies, yet now with a load on the upper legs of 70 millimetres of mercury 31, decreasing to about 15 millimetres of mercury 32 toward the sensitive sit bones and coccyx. The projections of the sensitive elements therefore lie in an area with a very low pressure load.

Figure 7:
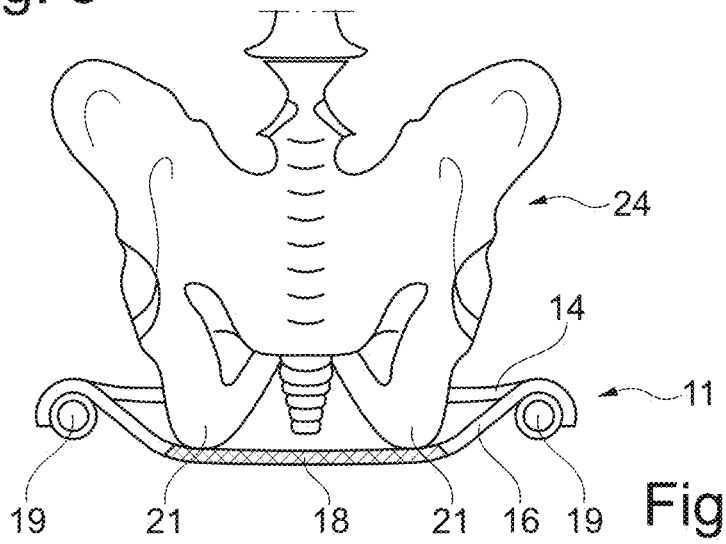
FIG. 7 shows in rear view a section of the first seat part of a seat according to FIG. 2.

FIG. 7 shows in rear view a section of the first seat part 14 of a seat 11 according to FIG. 2. The elastic segment 18 of the strip 16 of the first seat part 14 is deformed and follows the contour formed by the sit bones 21 of the shown bone structure 24 of the pelvis.

Figure 8:
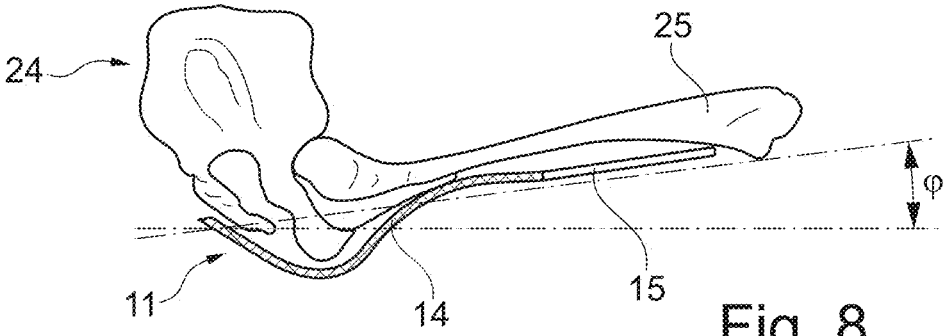
FIG. 8 shows in side view a section of a seat according to FIG. 2.

FIG. 8 shows in side view a section of a seat 11 according to FIG. 2. The shown bone structure 24 of the pelvis and upper leg 25 are supported by respectively the first seat part 14 which has shaped itself to the contour and the second, posture-imparting seat part 15. In combination with a back-rest (not shown) a sustainable seating is obtained with a seat 11 placed at the correct angle φ, wherein the risk of decubitus symptoms is reduced in effective manner.

The invention claimed is:

1. A seat for supporting a bottom of a seated user, which seat comprises a first seat part for supporting a first part of the bottom of the user and a second seat part for supporting a second part of the bottom of the user, wherein the first seat part is elastically deformable and has a first modulus of elasticity and wherein the second seat part has a second modulus of elasticity which is at least 10 times greater than the first modulus of elasticity, wherein the first seat part and second seat part comprise flexible straps extending between two frame parts, the two frame parts having a folded up position and a collapsed position, wherein, in the open position, the second seat part straps are tensioned to achieve the second modulus of elasticity.

2. The seat according to claim 1, wherein the first modulus of elasticity is smaller than or equal to 0.01 GPa.

3. The seat according to claim 1, wherein the second modulus of elasticity is greater than or equal to 0.1 GPa.

4. The seat according to claim 1, wherein the first seat part lies centrally relative to the seat and the second seat part surrounds the first seat part.

5. The seat according to claim 1, wherein the first seat part comprises the projected position of at least one of the pubic area, the coccyx or one or both sit bones of the user.

6. The seat according to claim 1, wherein the second seat part comprises the projected position of at least a part of the thighbones of the user.

7. The seat according to claim 1, wherein the flexible straps of the first seat part comprise at least one elastic strap.

8. The seat according to claim 1, wherein the first and/or the second seat part is covered with a soft foam layer.

9. The seat according to claim 3, wherein the second modulus of elasticity is in the range of 0.1-0.9 GPa.

10. The seat according to claim 7, wherein the at least one elastic strap is adjustable.

* * * * *